US008339227B2

(12) United States Patent
Shimomura et al.

(10) Patent No.: US 8,339,227 B2
(45) Date of Patent: Dec. 25, 2012

(54) INDUCTANCE PART AND METHOD FOR MANUFACTURING THE SAME

(75) Inventors: Satoru Shimomura, Hyogo (JP); Kiyoshi Takagi, Hyogo (JP); Kazuaki Oonishi, Hyogo (JP)

(73) Assignee: Panasonic Corporation, Osaka (JP)

( * ) Notice: Subject to any disclaimer, the term of this patent is extended or adjusted under 35 U.S.C. 154(b) by 153 days.

(21) Appl. No.: 12/743,743

(22) PCT Filed: Dec. 11, 2008

(86) PCT No.: PCT/JP2008/003710

§ 371 (c)(1),
(2), (4) Date: May 19, 2010

(87) PCT Pub. No.: WO2009/075110

PCT Pub. Date: Jun. 18, 2009

(65) Prior Publication Data

US 2010/0253463 A1 Oct. 7, 2010

(30) Foreign Application Priority Data

| | | |
|---|---|---|
| Dec. 12, 2007 | (JP) | 2007-320369 |
| Jan. 15, 2008 | (JP) | 2008-005344 |
| Jan. 18, 2008 | (JP) | 2008-008862 |
| Feb. 7, 2008 | (JP) | 2008-027455 |

(51) Int. Cl.
*H01F 27/02* (2006.01)

(52) U.S. Cl. ..... 336/83

(58) Field of Classification Search ..... 336/90, 336/96, 83, 65, 200, 232–233
See application file for complete search history.

(56) References Cited

U.S. PATENT DOCUMENTS

| | | | | |
|---|---|---|---|---|
| 3,451,934 | A * | 6/1969 | Hubbard | 252/62.54 |
| 6,054,210 | A * | 4/2000 | Bryant et al. | 428/328 |
| 6,328,817 | B1 * | 12/2001 | Murakami | 148/105 |
| 6,985,062 | B2 | 1/2006 | Nakata et al. | |
| 7,230,514 | B2 * | 6/2007 | Brunner | 336/90 |
| 7,362,201 | B2 * | 4/2008 | Saegusa et al. | 336/90 |
| 7,401,398 | B2 * | 7/2008 | Matsutani et al. | 29/606 |
| 7,469,469 | B2 | 12/2008 | Nakata et al. | |
| 2004/0051621 | A1 | 3/2004 | Nakata et al. | |
| 2005/0254989 | A1 | 11/2005 | Fujiwara et al. | |
| 2006/0049908 | A1 | 3/2006 | Nakata et al. | |
| 2008/0012674 | A1 | 1/2008 | Sano et al. | |
| 2009/0212894 | A1 * | 8/2009 | Hsieh et al. | 336/83 |
| 2010/0148902 | A1 * | 6/2010 | Shin et al. | 336/90 |

FOREIGN PATENT DOCUMENTS

| | | |
|---|---|---|
| CN | 1494093 A | 5/2004 |
| JP | 2004-111456 | 4/2004 |
| JP | 2004-327523 | 11/2004 |
| JP | 2005-310864 | 11/2005 |
| JP | 2006-032907 | 2/2006 |
| JP | 2007-214425 | 8/2007 |
| WO | WO 2006/070544 A1 | 7/2006 |

* cited by examiner

*Primary Examiner* — Tuyen Nguyen
(74) *Attorney, Agent, or Firm* — McDermott Will & Emery LLP

(57) ABSTRACT

Disclosed is an inductance part including a coiled conductor formed from a metal conductor, a magnetic body formed by pressure-molding a mixture of metal magnetic powder and bonding material in such a manner that the coiled conductor is embedded in the mixture, and a terminal derived from the coiled conductor. The coiled conductor is formed in a single layer with no insulating film on its surface. The metal magnetic powder of the magnetic body penetrates into the surface of the coiled conductor so as to make the filling factor of the metal magnetic powder in the magnetic body not less than 80% by volume.

12 Claims, 9 Drawing Sheets

FIG. 13
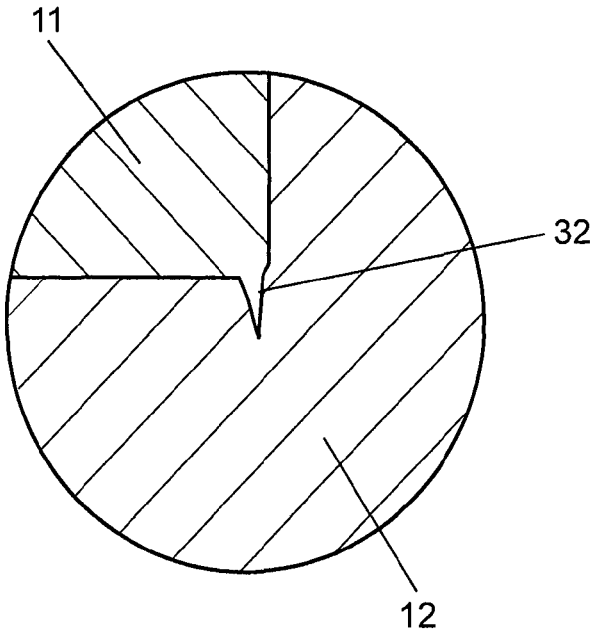
FIG. 14 PRIOR ART
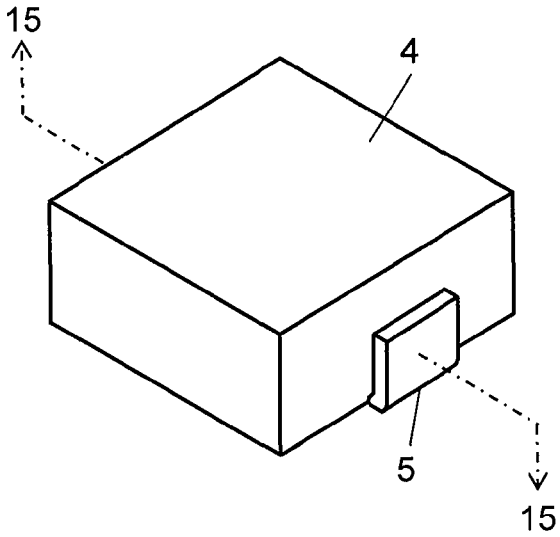

INDUCTANCE PART AND METHOD FOR MANUFACTURING THE SAME

RELATED APPLICATIONS

This application is the U.S. National Phase under 35 U.S.C. §371 of International Application No. PCT/JP2008/003710, filed on Dec. 11, 2008, which in turn claims the benefit of Japanese Application No. 2007-320369, filed on Dec. 12, 2007, Japanese Application No. 2008-005344, filed on Jan. 15, 2008, Japanese Application No. 2008-008862, filed on Jan. 18, 2008 and Japanese Application No. 2008-027455, filed on Feb. 7, 2008 the disclosures of which Applications are incorporated by reference herein.

TECHNICAL FIELD

The present invention relates to inductance parts used particularly as power choke coils in various electronic devices, and a method for manufacturing the inductance parts.

BACKGROUND ART

Power supply circuits used in computers and the like in recent years operate in a high-frequency domain of 300 kHz to 1 MHz. Inductance parts used in these power supply circuits are required to have an inductance value of about 1 μH and a DC resistance of several milliohms and also to correspond to a large current of over ten amperes. To meet these demands, there have been proposed inductance parts having dimensions of about 10 mm wide, 10 mm deep, and 4 mm high, and having a so-called compressed powder magnetic core. The compressed powder magnetic core is formed by embedding a coil in metal magnetic powder having a high saturation magnetic flux density at a high-frequency current.

A conventional inductance part will be described as follows with reference to drawings.

FIG. 14 is a perspective view of the conventional inductance part. FIG. 15 is a sectional view of FIG. 14 taken along a line 15-15. FIG. 16 is a plan view of a coil part of the conventional inductance part in which ring parts are arranged two-dimensionally. FIG. 17 is a perspective view of the coil part of the conventional inductance part in which the ring parts are superimposed on each other.

As shown in FIGS. 14 to 17, the conventional inductance part includes coil part 3, magnetic body 4, and terminals 5. The coil part is formed by bending ring parts 2 at connection parts 1 and superimposing them over each other. Ring parts 2 are made of metal plates arranged two-dimensionally and connected via connection parts 1. Magnetic body 4 is formed by pressure-molding a mixture of insulating resin and metal magnetic powder in such a manner that coil part 3 is embedded in the mixture. Terminals 5 are formed by extending both ends of coil part 3 from magnetic body 4. Ring parts 2 are provided on their surfaces with insulating film 6 (shown with a hatched pattern in FIG. 16). The insulating film prevents a short-circuit between adjacent ring parts 2 when they are superimposed on each other. An example of a conventional technique related to this application is shown in Patent Literature 1.

To achieve further miniaturization of electronic devices, power supply circuits have been miniaturized by increasing the operating frequency in recent years. In line with this, inductance parts have also been strongly required to operate at higher frequencies and to reduce their sizes. In order to miniaturize this type of inductance parts, it is necessary to increase the relative magnetic permeability of magnetic body 4, for which it is necessary to increase the filling factor of the metal magnetic powder in magnetic body 4.

In the above-described conventional inductance part, insulating film 6 is provided on the surface of each of ring parts 2 so as to prevent a short-circuit between adjacent ring parts 2 when they are superimposed on each other. Therefore, it is essential, during the formation of magnetic body 4 by pressure-molding, to prevent insulating film 6 from being damaged by ring parts 2 that have broken into each other due to the deformation of coil part 3 or being broken by the metal magnetic powder. To achieve this, magnetic body 4 is formed by pressure-molding metal magnetic powder at a pressure of 196 to 392 MPa (2 to 4 t/cm$^2$). Under this pressure, however, the filling factor of the metal magnetic powder in magnetic body 4 cannot be set higher than 75% by volume. Therefore, the conventional method has limitations in miniaturizing inductance parts by increasing the filling factor of the metal magnetic powder in magnetic body 4.

Patent Literature 1: Japanese Patent Unexamined Publication No. 2004-111456

SUMMARY OF THE INVENTION

The present invention has an object of providing an inductance part which is reduced in size by increasing the filling factor of metal magnetic powder in a magnetic body, and a method for manufacturing the inductance part.

The inductance part of the present invention includes a coiled conductor formed from a metal conductor, a magnetic body formed by pressure-molding a mixture of metal magnetic powder and bonding material in such a manner that the coiled conductor is embedded in the mixture, and a terminal derived from the coiled conductor. The coiled conductor is formed in a single layer with no insulating film on the surface thereof. The metal magnetic powder of the magnetic body penetrates into the surface of the coiled conductor so as to make the filling factor of the metal magnetic powder in the magnetic body not less than 80% by volume.

With this structure, the magnetic body has a high relative magnetic permeability, thereby achieving the miniaturization of the inductance part.

BRIEF DESCRIPTION OF THE DRAWINGS

FIG. 13 is an enlarged view of a part H of FIG. 12.

FIG. 14 is a perspective view of a conventional inductance part.

REFERENCE MARKS IN THE DRAWINGS

Figure 1:
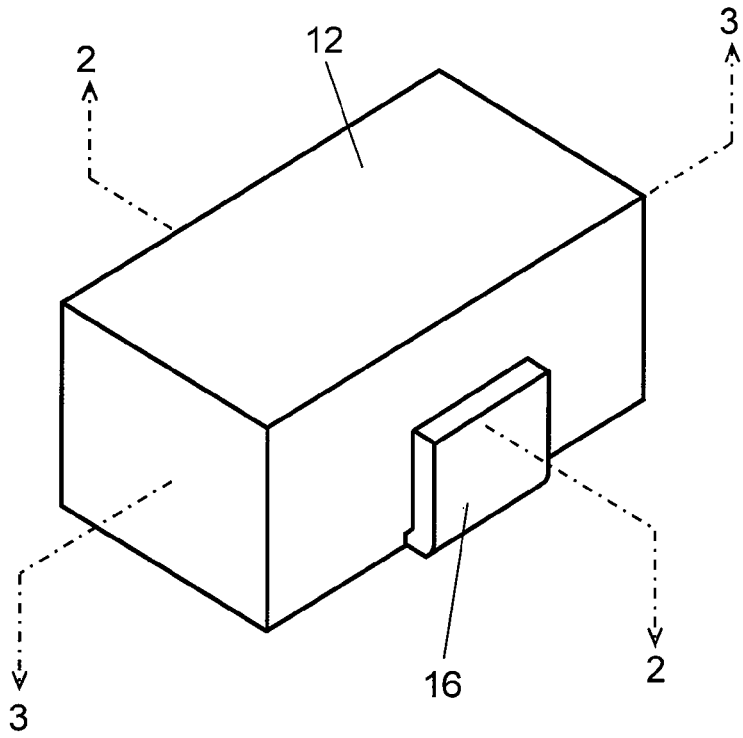
FIG. 1 is a perspective view of an inductance part according to a first exemplary embodiment of the present invention.

11 coiled conductor
12 magnetic body
13 metal magnetic powder
14 bonding material
15 electrical insulating material
16 terminal
17 asperities
18 vicinity-of-the-coiled-conductor
19 mold
20 punch
21 upper surface portion
22 lower surface portion
23 intermediate portion
24 upper surface portion's thickness
25 lower surface portion's thickness
26 intermediate portion's thickness
27 upward-bent part
28 laterally-bent part
29 bias portion
30 bending angle
31 terminal's height
32 projection
33 high density layer
34 low density layer
35 pre-compressed compact

DETAILED DESCRIPTION OF PREFERRED EMBODIMENTS

First Exemplary Embodiment

An inductance part of the present invention will be described as follows as a first exemplary embodiment with reference to drawings.

Figure 2:
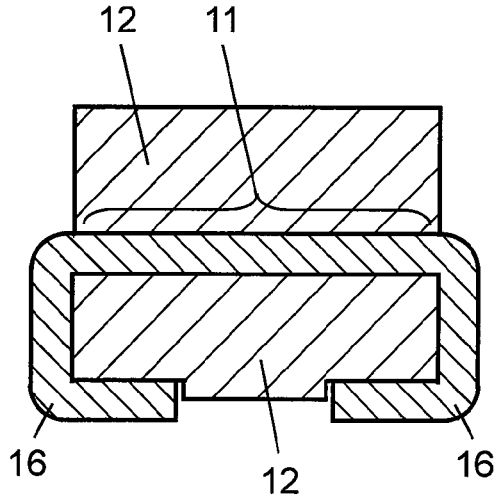
FIG. 2 is a sectional view of FIG. 1 taken along a line 2-2.
Figure 3:
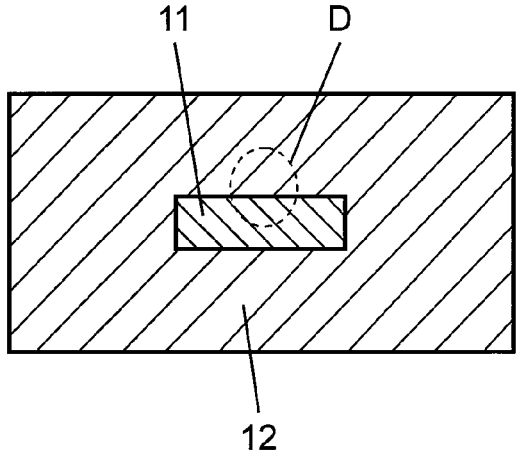
FIG. 3 is a sectional view of FIG. 1 taken along a line 3-3.
Figure 4:
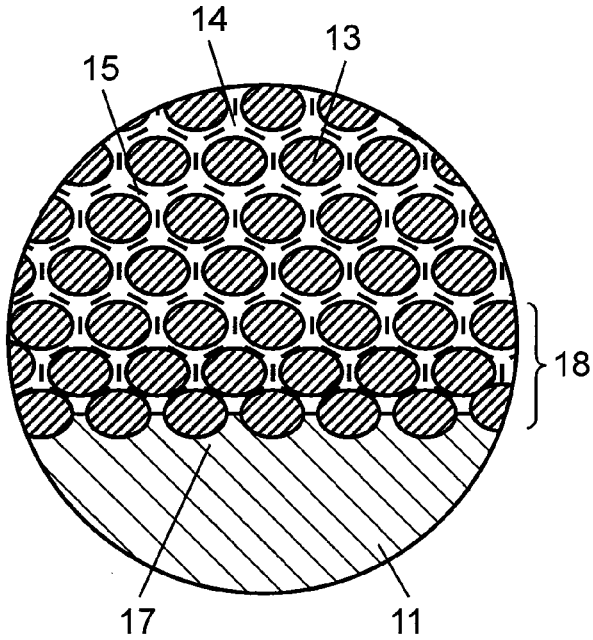
FIG. 4 is an enlarged schematic diagram of a part D of FIG. 3.

FIG. 1 is a perspective view of an inductance part of the first exemplary embodiment. FIG. 2 is a sectional view of FIG. 1 taken along a line 2-2. FIG. 3 is a sectional view of FIG. 1 taken along a line 3-3. FIG. 4 is an enlarged schematic diagram of a part D of FIG. 3.

In FIGS. 1 to 4, the inductance part includes coiled conductor 11, which is formed from a metal conductor such as a copper plate. Coiled conductor 11 is formed in a single layer by linearly punching a metal plate, and is not provided on its surface with an insulating film. Coiled conductor 11 may be made of any material having excellent conductivity such as a copper plate having a Vickers hardness of 50 to 150 (HV).

The inductance part further includes magnetic body 12, which is formed by pressure-molding a mixture of metal magnetic powder 13 and bonding material 14. The inductance part further includes terminals 16, which are formed by embedding coiled conductor 11 in the mixture and then deriving both ends of coiled conductor 11 from both sides of magnetic body 12. Metal magnetic powder 13 is preferably made of a material harder than coiled conductor 11, such as FeSiAl powder having a Vickers hardness of 400 to 500 (HV).

Metal magnetic powder 13 as a component of magnetic body 12 preferably has high saturation magnetic flux density and high relative magnetic permeability such as Fe, FeSi, FeNi, FeCo, or FeMo magnetic powder. Metal magnetic powder 13 should have a particle size of 1 to 100 μm, and is preferably pulverized or atomized to have an average particle size of 20 μm or less. In addition, metal magnetic powder 13 is preferably coated with an oxide film (not shown). Such an oxide film is generated to some degree even when metal magnetic powder 13 is left unattended, but the thickness is generally only 5 nm or less. Therefore, it is preferable to provide a heat treatment or the like to make the oxide film have a thickness of 10 to 500 nm.

Bonding material 14 can be either organic material such as acrylic resin, epoxy resin, silicone resin, phenol resin, vinyl chloride resin or inorganic material such as water glass. In FIG. 4, bonding material 14 is shown as a non-hatched region.

Metal magnetic powder 13 of magnetic body 12 preferably has electrical insulating material 15 interposed between its particles. Electrical insulating material 15 preferably has an average particle size of one-tenth or less of metal magnetic powder 13, and is a solid powder in a planar or acicular shape. Specific examples of electrical insulating material 15 include talc, boron nitride, a zinc oxide, a titanium oxide, an aluminum oxide, an iron oxide, and barium nitrate. Electrical insulating material 15 can be interposed between the particles of metal magnetic powder 13 by adding it when metal magnetic powder 13 and bonding material 14 are mixed.

Magnetic body 12 is formed by pressure-molding metal magnetic powder 13 at as high a pressure as to penetrate into the surface of coiled conductor 11 so as to plastic-deform metal magnetic powder 13. The filling factor of metal magnetic powder 13 in magnetic body 12 is not less than 80% by volume and less than 100% by volume. In this case, the pressure is preferably 490 MPa (5 t/cm$^2$) or more, and the filling factor can be increased with increasing pressure. Although it depends on the performance of the pressure molding machine or the mold, it is more preferable to perform the pressure-molding at a pressure of 960 MPa (10 t/cm$^2$). By forming magnetic body 12 with such a high pressure, metal magnetic powder 13 made of FeSiAl can be plastic-deformed. As a result, coiled conductor 11, which is made of copper softer than metal magnetic powder 13, is provided on its surface with asperities 17 having a depth of about 10 μm. Such asperities 17 can be formed by setting the filling factor of the metal magnetic powder in magnetic body 12 to 85% by volume.

As described above, metal magnetic powder 13 is pressure-molded to an extent to penetrate into the surface of coiled conductor 11. As a result, magnetic body 12 has a higher density in vicinity-of-the-coiled-conductor 18 than its average density. The term "vicinity-of-the-coiled-conductor 18" of magnetic body 12 refers to the region shown in FIG. 4 in which magnetic body 12 is in contact with coiled conductor 11. Magnetic body 12 has been subjected to straightening annealing to remove internal strains of metal magnetic powder 13 generated during the pressure-molding.

Terminals 16, which are both ends of coiled conductor 11 derived from magnetic body 12, are solder-plated on their outer sides and bent along the sides and the bottom of magnetic body 12.

The following is a description of a method for manufacturing the above-structured inductance part of the first exemplary embodiment.

Figure 5A:
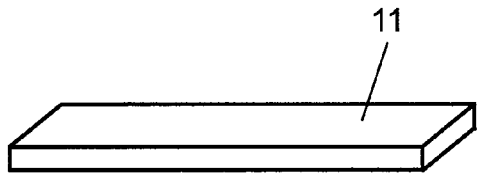
FIG. 5A shows a step of manufacturing an inductance part according to the first exemplary embodiment of the present invention.
Figure 5B:
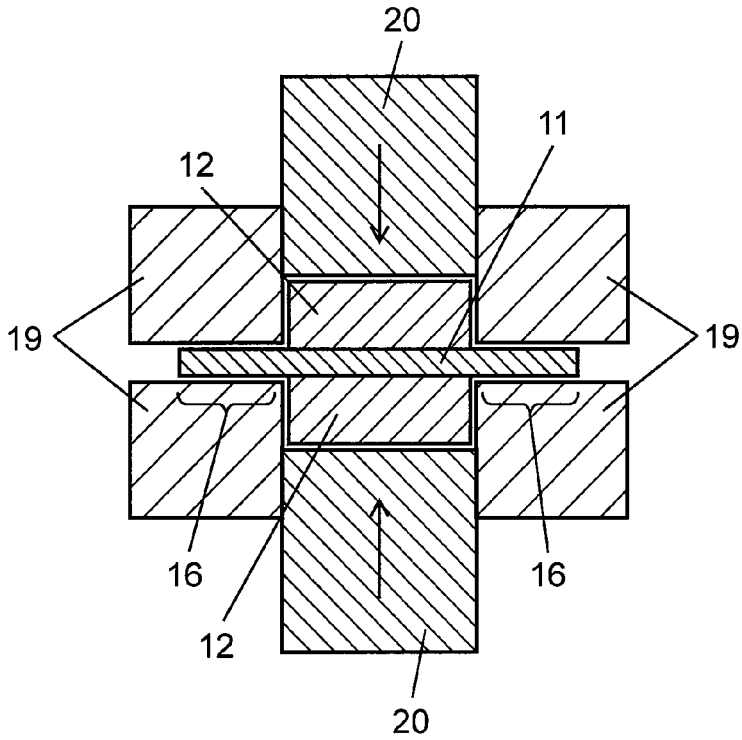
FIG. 5B shows another step of manufacturing the inductance part according to the first exemplary embodiment of the present invention.
Figure 5C:
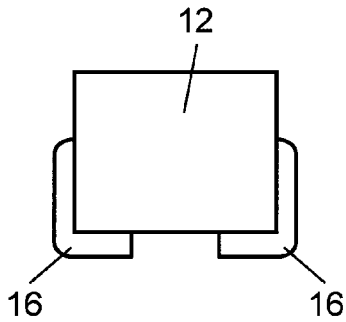
FIG. 5C shows another step of manufacturing the inductance part according to the first exemplary embodiment of the present invention.

FIGS. 5A to 5C show steps of manufacturing the inductance part of the first exemplary embodiment. As shown in FIGS. 5A to 5C, the method for manufacturing the inductance part of the first exemplary embodiment includes a step (FIG. 5A) of forming coiled conductor 11 from a metal conductor such as a copper plate, a step (FIG. 5B) of forming magnetic body 12 by pressure-molding a mixture of iron-based metal magnetic powder 13, bonding material 14, and electrical insulating material 15 in such a manner that the coiled conductor is embedded in the mixture, a step (not shown) of heat treating the pressure-molded body, and a step (FIG. 5C) of forming terminals 16 derived from coiled conductor 11.

In the step of forming the coiled conductor, a metal plate such as a copper plate is linearly punched by pressing or the like so as to form coiled conductor 11 in a single layer, with no insulating film on its surface.

In the step of forming the magnetic body, coiled conductor 11 which is sandwiched in a mixture of metal magnetic powder 13, bonding material 14, and electrical insulating material 15 is put in mold 19, and the mixture is pressure-molded in the direction of the arrow of FIG. 5B by the upper and lower portions of punch 20. In this step, metal magnetic powder 13 is pressure-molded at as high a pressure as to penetrate into the surface of coiled conductor 11 so as to be plastic-deformed to make the filling factor of metal magnetic powder 13 in magnetic body 12 not less than 80% by volume and less than 100% by volume. In this case, the pressure is preferably 490 MPa (5 t/cm$^2$) or more, and the filling factor can be increased with increasing pressure. Although it depends on the performance of the pressure molding machine or the mold, it is more preferable to perform the pressure-molding at a pressure of 960 MPa (10 t/cm$^2$). As a result, metal magnetic powder 13 is plastic-deformed in such a manner as to penetrate into the surface of coiled conductor 11 as deep as about 10 μm and to allow the filling factor of metal magnetic powder 13 in magnetic body 12 to be 85% by volume. As described above, metal magnetic powder 13 is pressure-molded to an extent to penetrate into the surface of coiled conductor 11. As a result, magnetic body 12 has a higher density in vicinity-of-the-coiled-conductor 18 than its average density.

In the step of heat treating, the pressure-molded body which has been pressure-molded in the previous step of forming the magnetic body is held in an inert gas atmosphere such as a nitrogen atmosphere at 800° C. for over 30 minutes. The heat treatment can be performed at a temperature which is 600° C. or above and is lower than the temperature at which coiled conductor 11 and metal magnetic powder 13 are diffused by heat. It is alternatively possible to add, after the step of heat treating, a step (not shown) of impregnating magnetic body 12 with epoxy resin in order to reinforce its mechanical strength.

In the final step of forming the terminals, both ends of coiled conductor 11 derived from magnetic body 12 are solder-plated and bent along the sides and the bottom of magnetic body 12.

In the inductance part structured and manufactured as described above according to the first exemplary embodiment, coiled conductor 11 is formed in a single layer with no insulating film on its surface. This frees the inductance part from the problem in the conventional inductance part, that is, the problem of a short-circuit between ring parts 2 of coil part 3 when the pressure of the pressure-molding is as high as to break insulating film 6. As a result, in the formation of magnetic body 12, metal magnetic powder 13 can be pressure-molded at as high a pressure as to penetrate into the surface of coiled conductor 11 so as to make the filling factor of metal magnetic powder 13 not less than 80% by volume, thereby increasing the relative magnetic permeability of magnetic body 12.

Coiled conductor 11 having a linear shape is generally likely to move inside magnetic body 12 or to come out therefrom. However, metal magnetic powder 13 penetrating into the surface of coiled conductor 11 improves the peel strength between magnetic body 12 and coiled conductor 11, thereby preventing coiled conductor 11 from moving inside magnetic body 12 or coming out therefrom. This eliminates the presence of the mechanical stress applied to magnetic body 12 due to the movement of coiled conductor 11, thereby reducing the occurrence of cracks in magnetic body 12.

When coiled conductor 11 is supplied with a high-frequency current, the high-frequency current flows only through the skin of coiled conductor 11 due to a skin effect. However, metal magnetic powder 13 penetrating into the surface of coiled conductor 11 generates asperities 17 on the surface of coiled conductor 11 so as to increase the area through which the high-frequency current flows, thereby reducing the loss due to coiled conductor 11.

Since coiled conductor 11 is made of copper, which is softer than the iron-based alloy composing metal magnetic powder 13, metal magnetic powder 13 can penetrate deeply into the surface of coiled conductor 11 in the formation of magnetic body 12. This increases the filling factor of metal magnetic powder 13, and hence, the peel strength between coiled conductor 11 and metal magnetic powder 13, thereby improving the mechanical strength of magnetic body 12.

Vicinity-of-the-coiled-conductor 18 of magnetic body 12 has a higher density than the average density of magnetic body 12, and hence, has high saturation magnetic flux density. In the region in which magnetic body 12 is in contact with coiled conductor 11, a magnetic flux tends to concentrate, thereby efficiently increasing the inductance value.

Electrical insulating material 15 interposed between the particles of metal magnetic powder 13 prevents their contact, so that an eddy current generated in the metal magnetic powder due to a high-frequency current is prevented from flowing between the particles and increasing the eddy-current loss.

Magnetic body 12 is subjected to straightening annealing to remove internal strains of metal magnetic powder 13 generated during the pressure-molding to form magnetic body 12. As a result, magnetic body 12 has higher magnetic characteristics, allowing the inductance part to be further miniaturized.

In the step of forming the coiled conductor, coiled conductor 11 is formed in a single layer with no insulating film on its surface. This frees the inductance part from the problem in the conventional inductance part, that is, the problem of a short-circuit between ring parts 2 of coil part 3 when the pressure of the pressure-molding is as high as to break insulating film 6. As a result, in the formation of magnetic body 12, metal magnetic powder 13 can be pressure-molded at as high a pressure as to penetrate into the surface of coiled conductor 11 so as to have a filling factor of not less than 80% by volume, thereby increasing the relative magnetic permeability of magnetic body 12. Metal magnetic powder 13 penetrating into the surface of coiled conductor 11 improves the peel strength between magnetic body 12 and coiled conductor 11, thereby preventing coiled conductor 11 from moving inside magnetic body 12 or coming out therefrom. This eliminates the presence of the mechanical stress applied to magnetic body 12 due to the movement of coiled conductor 11, thereby reducing the occurrence of cracks in magnetic body 12.

When coiled conductor 11 is supplied with a high-frequency current, the high-frequency current flows only through the skin of coiled conductor 11 due to a skin effect. However, metal magnetic powder 13 penetrating into the surface of coiled conductor 11 generates asperities 17 on the surface of coiled conductor 11 so as to increase the area through which the high-frequency current flows, thereby reducing the loss due to coiled conductor 11. As a result, the inductance part can be miniaturized.

In the step of forming the magnetic body, the pressure-molding is performed by setting the density of magnetic body 12 in the vicinity of coiled conductor 11 higher than the average density of magnetic body 12. This allows the magnetic body to have high saturation magnetic flux density in vicinity-of-the-coiled-conductor 18. In the region in which magnetic body 12 is in contact with coiled conductor 11, a magnetic flux tends to concentrate, thereby efficiently increasing the inductance value.

In the step of heat treating, the heat treatment is performed at a temperature which is 600° C. or above and is lower than the temperature at which coiled conductor 11 and metal magnetic powder 13 are diffused by heat. Therefore, for example, when coiled conductor 11 is made of copper, and metal magnetic powder 13 is made of an iron-based alloy, the heat treatment can be performed at as high as about 900° C. Thus, a heat treatment at 600° C. or above can remove internal strains of metal magnetic powder 13 generated due to plastic-deformation during the pressure-molding. Thus, the straightening annealing of metal magnetic powder 13 can be performed without causing coiled conductor 11 and metal magnetic powder 13 to be diffused by heat, thereby allowing magnetic body 12 to have higher relative magnetic permeability. In the conventional inductance part in which insulating film 6 is formed on the surface of each of ring parts 2, the insulating film is pyrolyzed during the heat treatment, causing a short-circuit of ring parts 2. In the inductance part of the present invention, on the other hand, coiled conductor 11 is formed in a single layer with no insulating film on its surface. This makes it possible to perform straightening annealing at 600° C. or above to remove internal strains of metal magnetic powder 13.

In the heat treatment at 600° C. or above, adding an organic silicon compound to the bonding material allows the organic silicon compound to react with the oxygen contained in metal magnetic powder 13 during the heat treatment. Some of the reactant changes into silica, thereby improving insulation between the particles of metal magnetic powder 13. The oxygen contained in metal magnetic powder 13 can be either contained in the source material of metal magnetic powder 13 or incorporated during the production process.

From the above described results, in a high frequency range up to 10 MHz, the inductance part can be miniaturized to be 2 mm wide, 2 mm deep, and 1 mm high.

In the present first exemplary embodiment, the step of heat treating is performed as a step of straightening annealing to remove internal strains of metal magnetic powder 13. Alternatively, however, if a predetermined inductance value is obtained using metal magnetic powder 13 having internal strains generated during the pressure-molding, the step of straightening annealing can be replaced by a step of heat-curing the bonding material by a heat treatment at 100° C. to 300° C. In this case, the effects of the first exemplary embodiment other than the effect of the straightening annealing can be obtained in the same manner.

Second Exemplary Embodiment

The inductance part of the present invention will be described as follows as a second exemplary embodiment with reference to drawings. Like components are labeled with like reference numerals with respect to the first exemplary embodiment, and these components are not described again in detail.

Figure 6:
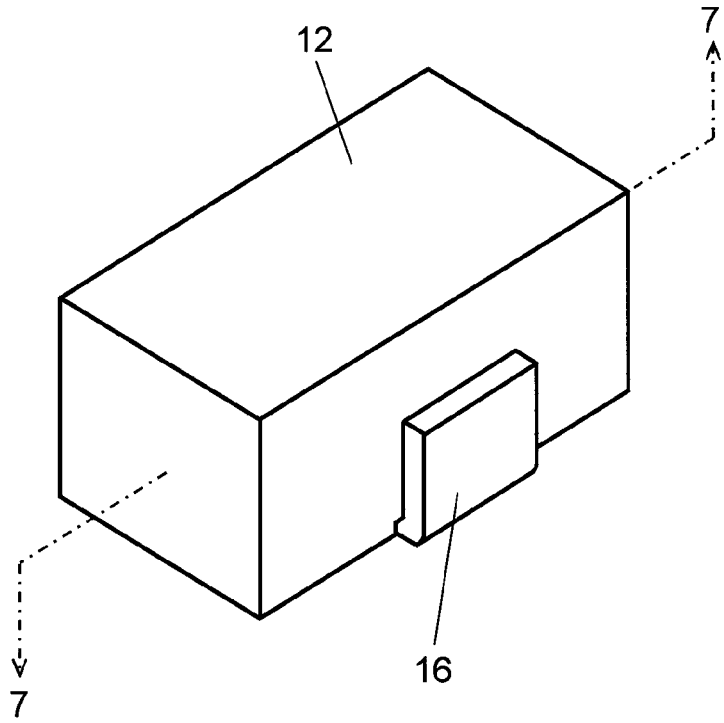
FIG. 6 is a perspective view of an inductance part according to a second exemplary embodiment of the present invention.
Figure 7:
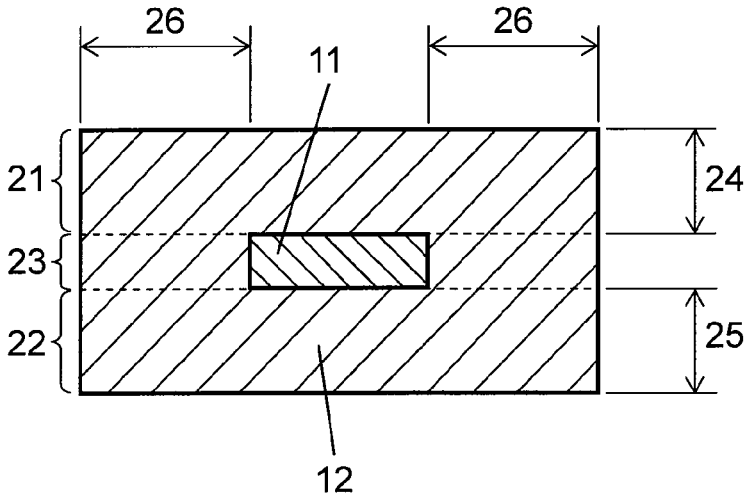
FIG. 7 is a sectional view of FIG. 6 taken along a line 7-7.

FIG. 6 is a perspective view of an inductance part of the second exemplary embodiment. FIG. 7 is a sectional view of FIG. 6 taken along a line 7-7. As shown in FIGS. 6 and 7, in the inductance part of the second exemplary embodiment, magnetic body 12 includes upper surface portion 21 above coiled conductor 11, lower surface portion 22 below coiled conductor 11, and intermediate portion 23 besides coiled conductor 11. Upper and lower surface portions 21 and 22 have a higher density than intermediate portion 23. Magnetic body 12 has intermediate portion's thickness 26, which is larger than upper surface portion's thickness 24 and lower surface portion's thickness 25.

In the cross section of rectangular magnetic body 12 shown in FIG. 7, the upper horizontal line represents the upper surface of magnetic body 12, and the lower horizontal line represents the lower surface of magnetic body 12. As shown in FIG. 7, upper surface portion's thickness 24 refers to the distance between the upper surface of coiled conductor 11 and the upper surface of magnetic body 12. Similarly, lower surface portion's thickness 25 refers to the distance between the lower surface of coiled conductor 11 and the lower surface of magnetic body 12. Intermediate portion's thickness 26 refers to the distance between the side surfaces of coiled conductor 11 and the side surfaces magnetic body 12.

The following is a description of a method for manufacturing the above-structured inductance part of the second exemplary embodiment.

Figure 8A:
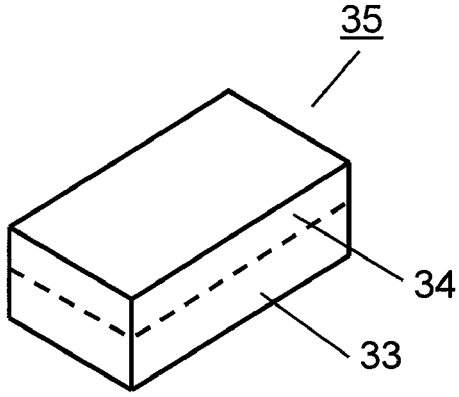
FIG. 8A shows a step of forming a magnetic body of the inductance part according to the second exemplary embodiment of the present invention.
Figure 8B:
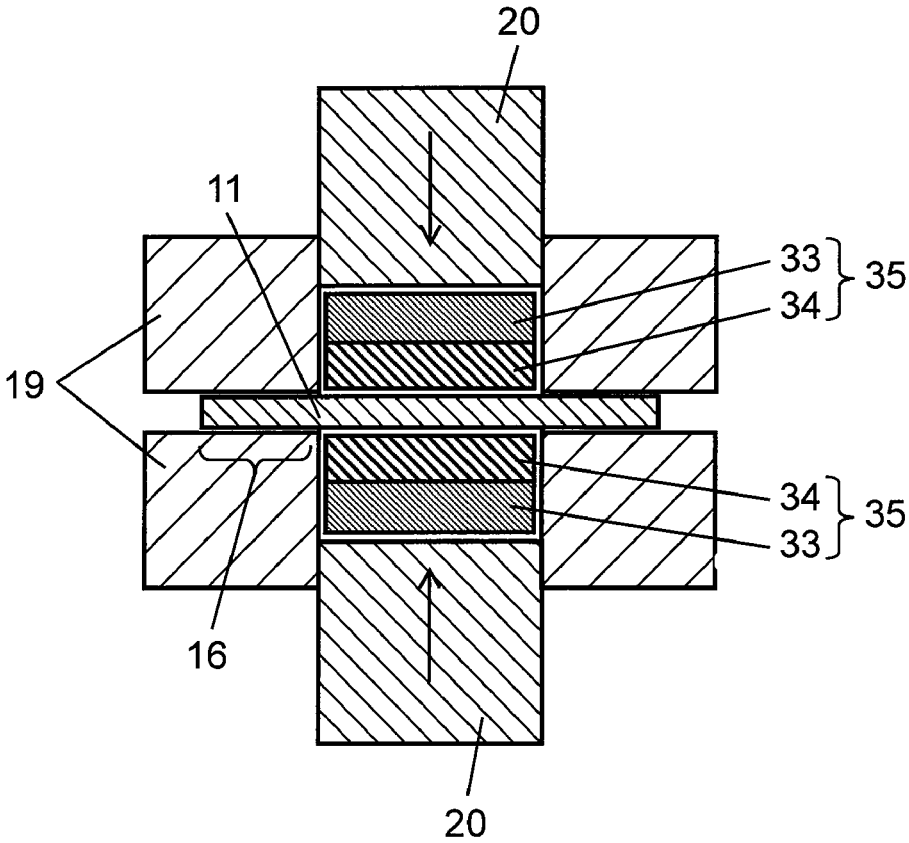
FIG. 8B shows another step of forming the magnetic body of the inductance part according to the second exemplary embodiment of the present invention.

FIGS. 8A and 8B show steps of forming a magnetic body of the inductance part of the second exemplary embodiment. As shown in FIGS. 8A and 8B, the method for manufacturing the inductance part of the second exemplary embodiment differs from the method of the first exemplary embodiment in the step of forming the magnetic body. As shown in FIG. 8A, a mixture of metal magnetic powder 13 and bonding material 14 is subjected to pre-pressure-molding at a pressure of about 98 MPa (1 t/cm$^2$) to form high density layer 33, and at a pressure of about 46 MPa (0.5 t/cm$^2$) to form low density layer 34. Low density layer 34 is stacked on high density layer 33 to produce pre-compressed compact 35. Two such pre-compressed compacts 35 are prepared.

Next, as shown in FIG. 8B, coiled conductor 11 is put into mold 19 in such a manner as to be sandwiched from above and below by two low density layers 34 of two pre-compressed compacts 35. Then, pre-compressed compacts 35 are subjected to full pressure-molding at a pressure of 490 MPa (5 t/cm$^2$), preferably 980 MPa (10 t/cm$^2$) until upper surface portion's thickness 24 and lower surface portion's thickness 25 of magnetic body 12 become smaller than intermediate portion's thickness 26. This makes the filling factor of the metal magnetic powder lager in upper and lower surface portions 21 and 22 of magnetic body 12, respectively, above and below coiled conductor 11 than in intermediate portion 23 besides coiled conductor 11.

In the above-structured inductance part of the second exemplary embodiment, upper and lower surface portions 21 and 22 of magnetic body 12, respectively, above and below coiled conductor 11 have a higher density than intermediate portion 23 besides coiled conductor 11. As a result, upper and lower surface portions 21 and 22 have a high saturation magnetic flux density, and are unlikely to undergo magnetic saturation. This allows upper surface portion's thickness 24 and lower surface portion's thickness 25 to be small, thereby achieving a miniaturized inductance part.

As described above, in magnetic body 12, intermediate portion's thickness 26 is larger than upper surface portion's thickness 24 and lower surface portion's thickness 25. Therefore, even when the inductance part is reduced in overall height by increasing the density of upper and lower surface portions 21 and 22 of magnetic body 12, intermediate portion 23 has a high saturation magnetic flux density, thereby reducing the occurrence of magnetic saturation. As compared with the case in which intermediate portion's thickness 26 is the same as upper surface portion's thickness 24 and lower surface portion's thickness 25, the volume of magnetic body 12 is large with respect to the volume of coiled conductor 11. As a result, magnetic body 12 has a high mechanical strength and is prevented from cracks induced by, for example, the external stress applied to terminals 16 derived from coiled conductor 11. In addition, upper and lower surface portions 21 and 22 of magnetic body 12 have a high strength because of their high density. The synergistic effect of the mechanical strength of magnetic body 12 and the strength of upper and lower surface portions 21 and 22 further reduces the occurrence of cracks in magnetic body 12 even when the inductance part is reduced in height.

Third Exemplary Embodiment

The inductance part of the present invention will be described as follows as a third exemplary embodiment with reference to drawings. Like components are labeled with like reference numerals with respect to the first exemplary embodiment, and these components are not described again in detail.

Figure 9:
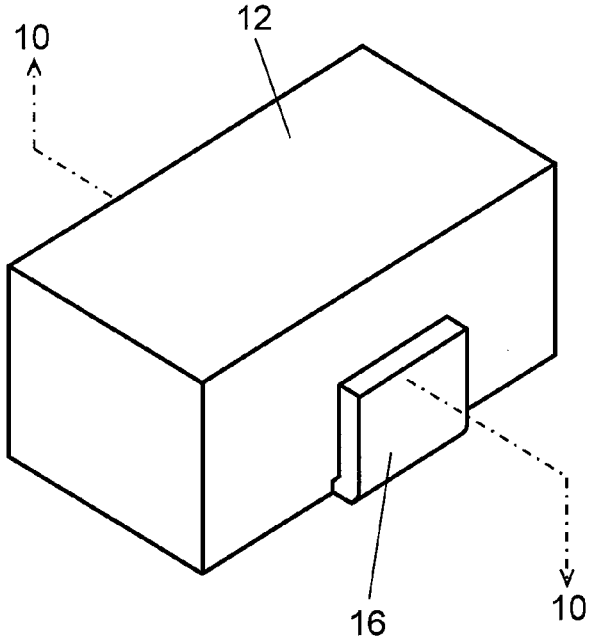
FIG. 9 is a perspective view of an inductance part according to a third exemplary embodiment of the present invention.
Figure 10:
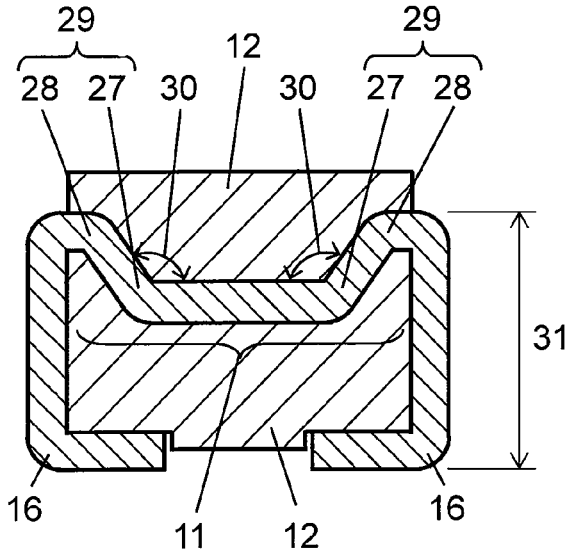
FIG. 10 is a sectional view of FIG. 9 taken along a line 10-10.

FIG. 9 is a perspective view of an inductance part of the third exemplary embodiment. FIG. 10 is a sectional view of FIG. 9 taken along a line 10-10. In FIGS. 9 and 10, coiled conductor 11 includes bias portions 29 at both ends thereof connected to terminals 16. Bias portions 29 each include upward-bent part 27 which is bent upward and laterally-bent part 28 which is bent laterally. Coiled conductor 11 has its center located at the substantial center of the upper and lower surfaces of magnetic body 12. Terminals 16 are biased toward the top of the side surfaces of magnetic body 12 and derived from coiled conductor 11.

The shape of coiled conductor 11 will be described in greater detail as follows. Upward-bent part 27 has bending angle 30 of 90 degrees or more and less than 180 degrees. Bending angle 30 is preferably large enough to avoid an increase in the magnetic flux density of coiled conductor 11. The high magnetic flux density is generated by the superimposition of the magnetic flux generated between upward-bent part 27 and laterally-bent part 28 and the magnetic flux generated at the substantial center of magnetic body 12. Laterally-bent part 28 is horizontally bent toward the side surfaces of magnetic body 12.

In the cross section of rectangular magnetic body 12 shown in FIG. 10, the upper horizontal line represents the upper surface of magnetic body 12, and the lower horizontal line represents the lower surface of magnetic body 12. The center of coiled conductor 11 is located at the substantial center of the upper and lower surfaces of magnetic body 12. The term "substantial center" includes both the exact center of the upper and lower surfaces of magnetic body 12 and positions slightly shifted from the exact center due to variations during manufacture or other causes.

In the above-structured inductance part of the third exemplary embodiment, coiled conductor 11 includes bias portions 29 at both ends thereof connected to terminals 16. Bias portions 29 each include upward-bent part 27 which is bent upward and laterally-bent part 28 which is bent laterally. The center of coiled conductor 11 is located at the substantial center of the upper and lower surfaces of magnetic body 12, and terminals 16 are biased toward the top of the side surfaces of magnetic body 12 and derived from coiled conductor 11. Therefore, when terminals 16 are bent along the sides and the bottom of magnetic body 12, magnetic body 12 has large terminal's height 31 because of bias portions 29. This makes it easy to form solder fillets (not shown) when terminals 16 are solder-connected to a mounting substrate (not shown). As a result, the inductance part can be miniaturized without damaging solder mounting.

In general, when terminals 16 are biased toward the top of the side surfaces of magnetic body 12 and derived from coiled conductor 11, coiled conductor 11 is located closer to the upper surface of magnetic body 12 than to the bottom surface thereof. As a result, coiled conductor 11 has a different magnetic flux density between the upper and lower surface sides, thereby having low magnetic efficiency. In the inductance part of the third exemplary embodiment, however, bias portions 29 allow coiled conductor 11 to be located at the substantial center of magnetic body 12. As a result, the magnetic flux generated by coiled conductor 11 can be evenly distributed in magnetic body 12, thereby efficiently increasing the inductance value.

Increasing the filling factor of metal magnetic powder 13 as in the present invention can increase the magnetic flux saturation of magnetic body 12, making the shape and the size of magnetic body 12 give a large influence to the characteristics of the inductance part. When the coiled conductor 11 is formed in a single layer as in the present invention, the line of magnetic force caused by the current flowing through coiled conductor 11 is concentric with the direction of the current flowing through coiled conductor 11. This makes the inductance value more affected by the cross-sectional shape of magnetic body 12 in the direction perpendicular to the direction of the current through coiled conductor 11. The inductance value can be efficiently increased by locating coiled conductor 11 in the center of magnetic body 12 as described in the third exemplary embodiment, thereby achieving further miniaturization of the inductance part.

Fourth Exemplary Embodiment

The inductance part of the present invention will be described as follows as a fourth exemplary embodiment with reference to drawings. Like components are labeled with like reference numerals with respect to the first exemplary embodiment, and these components are not described again in detail.

Figure 11:
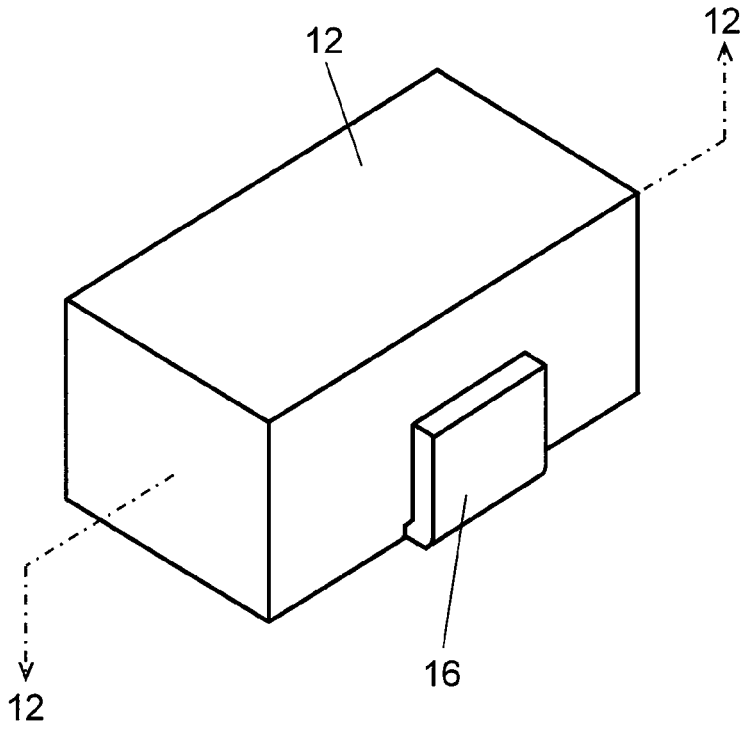
FIG. 11 is a perspective view of an inductance part according to a fourth exemplary embodiment of the present invention.
Figure 12:
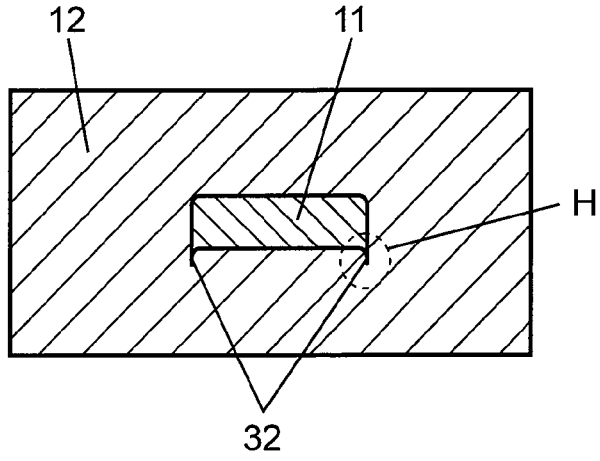
FIG. 12 is a sectional view of FIG. 11 taken along a line 12-12.
Figure 15:
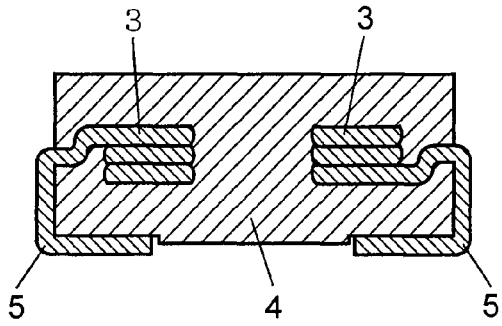
FIG. 15 PRIOR ART
FIG. 15 is a sectional view of FIG. 14 taken along a line 15-15.
Figure 16:
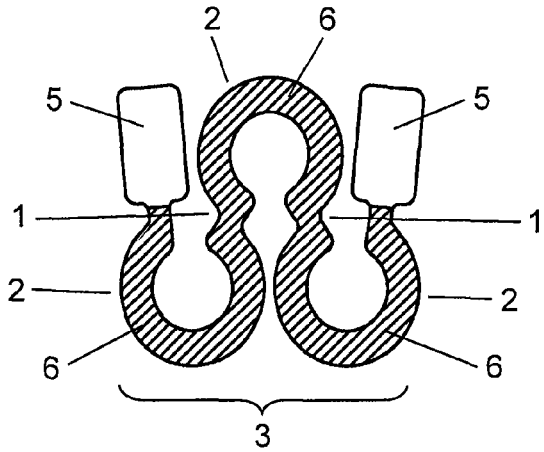
FIG. 16 PRIOR ART
FIG. 16 is a plan view of a coil part of the conventional inductance part in which ring parts are arranged two-dimensionally.
Figure 17:
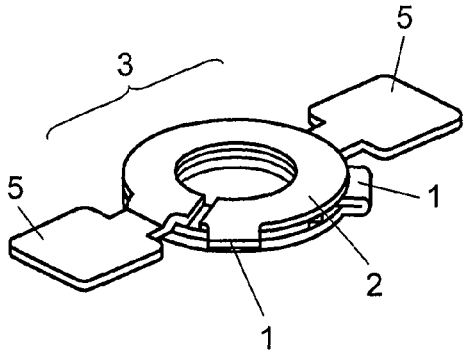
FIG. 17 PRIOR ART
FIG. 17 is a perspective view of the coil part of the conventional inductance part in which the ring parts are superimposed on each other.

FIG. 11 is a perspective view of an inductance part of the fourth exemplary embodiment. FIG. 12 is a sectional view of FIG. 11 taken along a line 12-12. FIG. 13 is an enlarged view of a part H of FIG. 12. As shown in FIGS. 11 to 13, in the inductance part of the fourth exemplary embodiment, coiled conductor 11 is provided at the edges of either the upper or lower surface thereof with projections 32 extending in the direction perpendicular to the upper or lower surface thereof.

In the above-structured inductance part of the fourth exemplary embodiment, projections 32 dig into magnetic body 12, so that coiled conductor 11 provides an anchor effect to magnetic body 12, and hence, increases the mechanical strength of the inductance part. The presence of projections 32 also increases the surface area in which coiled conductor 11 and magnetic body 12 are contact with each other. This allows the heat generated when coiled conductor 11 is supplied with current to be readily released to magnetic body 12, thereby reducing the temperature increase.

INDUSTRIAL APPLICABILITY

According to the inductance part of the present invention, in the formation of the magnetic body, the metal magnetic powder is pressure-molded at a pressure high enough to allow the filling factor of the metal magnetic powder in the magnetic body to be not less than 80% by volume. This increases the relative magnetic permeability of the magnetic body, making the inductance part smaller, and hence, useful in various electronic devices.

The invention claimed is:

1. An inductance part comprising:

a coiled conductor formed from a metal conductor;

a magnetic body formed by pressure-molding a mixture of metal magnetic powder and bonding material in such a manner that the coiled conductor is embedded in the mixture; and a terminal derived from the coiled conductor, wherein:

the coiled conductor is formed in a single layer with no insulating film on a surface thereof, a part of the metal magnetic powder of the magnetic body is embedded into a surface of the coiled conductor, and a filling factor of the metal magnetic powder in the magnetic body is not less than 80% by volume, and the magnetic material powder is coated with an oxide film of a material constituting the magnetic material powder.

2. The inductance part of claim 1, wherein the coiled conductor is made of a softer material than the metal magnetic powder.

3. The inductance part of claim 1, wherein the magnetic body has a higher density in a vicinity of the coiled conductor than an average density of the magnetic body.

4. The inductance part of claim 1, wherein the metal magnetic powder has an electrical insulating material interposed between particles thereof.

5. The inductance part of claim 1, wherein the magnetic body is subjected to straightening annealing to remove internal strains of the metal magnetic powder.

6. The inductance part of claim 1, wherein the magnetic body includes an upper surface portion above the coiled conductor, a lower surface portion below the coiled conductor, and an intermediate portion besides the coiled conductor, the upper surface portion and the lower surface portion having a higher density than the intermediate portion.

7. The electronic component of claim 6, wherein the intermediate portion of the magnetic body has a larger thickness than the upper surface portion and the lower surface portion.

8. An inductance part comprising:

a coiled conductor formed from a metal conductor;

a magnetic body formed by pressure-molding a mixture of metal magnetic powder and bonding material in such a manner that the coiled conductor is embedded in the mixture; and a terminal derived from the coiled conductor, wherein:

the coiled conductor is formed in a single layer with no insulating film on a surface thereof, a part of the metal magnetic powder of the magnetic body is embedded into a surface of the coiled conductor, a filling factor of the metal magnetic powder in the magnetic body is not less than 80% by volume, the coiled conductor includes bias portions at both ends thereof connected to the terminals, the bias portions each including an upward-bent part bent upward and a laterally-bent part bent laterally, the coiled conductor has a center thereof located at a substantial center of an upper surface and a lower surface of the magnetic body, and the terminals are biased toward a top of side surfaces of the magnetic body and derived from the coiled conductor.

9. The inductance part of claim 1, wherein the coiled conductor includes a projection at an edge of one of an upper surface and a lower surface thereof, the projection extending in a direction perpendicular to one of the upper surface and the lower surface thereof.

10. The inductance part of claim 1, wherein the magnetic body has a non-uniform density.

11. An inductance part comprising:

a coiled conductor formed from a metal conductor;

a magnetic body formed by pressure-molding a mixture of metal magnetic powder, an electrical insulating material and bonding material in such a manner that the coiled conductor is embedded in the mixture; and a terminal derived from the coiled conductor, wherein:

the coiled conductor is formed in a single layer with no insulating film on a surface thereof, a part of the metal magnetic powder of the magnetic body is embedded into a surface of the coiled conductor, a filling factor of the metal magnetic powder in the magnetic body is not less than 80% by volume, the electrical insulating material is interposed between the particles of metal magnetic powder, and the electrical insulating material includes at least one of talc, boron nitride, zinc oxide, titanium oxide, aluminum oxide, iron oxide, and barium nitrate.

12. The inductance part of claim 1, wherein the oxide film has a thickness of 10 to 500 nm.

* * * * *